US010968846B2

(12) United States Patent
Dudar

(10) Patent No.: US 10,968,846 B2
(45) Date of Patent: Apr. 6, 2021

(54) METHOD AND SYSTEM FOR PURGE CONTROL

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 87 days.

(21) Appl. No.: 16/272,799

(22) Filed: Feb. 11, 2019

(65) Prior Publication Data

US 2020/0256267 A1 Aug. 13, 2020

(51) Int. Cl.
*F02D 41/00* (2006.01)
*F02D 41/22* (2006.01)

(52) U.S. Cl.
CPC ..... *F02D 41/0035* (2013.01); *F02D 41/0087* (2013.01); *F02D 41/221* (2013.01); *F02D 2200/60* (2013.01)

(58) Field of Classification Search
CPC ..... F02D 41/0035; F02D 41/0087; F02D 41/221; F02D 2200/60
USPC ..... 123/520
See application file for complete search history.

(56) References Cited

U.S. PATENT DOCUMENTS

| | | | | |
|---|---|---|---|---|
| 6,820,597 | B1 | 11/2004 | Cullen et al. | |
| 7,503,167 | B2 | 3/2009 | Jankovic | |
| 2008/0066450 | A1 | 3/2008 | Surnilla et al. | |
| 2013/0269660 | A1* | 10/2013 | Peters | F02D 41/0045 123/520 |
| 2014/0366508 | A1* | 12/2014 | Ulrey | F02D 41/0275 60/274 |
| 2015/0345371 | A1* | 12/2015 | Russ | F02D 41/0007 123/542 |
| 2017/0328292 | A1* | 11/2017 | Leone | F02D 41/0087 |

* cited by examiner

*Primary Examiner* — Joseph J Dallo
*Assistant Examiner* — Yi-Kai Wang
(74) *Attorney, Agent, or Firm* — Geoffrey Brumbaugh; McCoy Russell LLP

(57) ABSTRACT

Methods and systems are provided for reducing engine stall incidence during canister purging. A fuel vapor canister is purged at a higher purge ramp rate to an engine with one or more cylinders selectively deactivated. In response to an indication of potential or partial engine stall, the deactivated cylinders are reactivated and the canister purge ramp rate is lowered.

20 Claims, 4 Drawing Sheets

METHOD AND SYSTEM FOR PURGE CONTROL

FIELD

The present description relates generally to methods and systems for controlling a vehicle engine to reduce engine stalls during fuel vapor canister purging.

BACKGROUND/SUMMARY

Vehicle fuel systems may include a fuel vapor canister packed with adsorbent for adsorbing fuel tank vapors. The fuel tank vapors adsorbed may include refueling vapors, diurnal vapors, as well as vapors released during fuel tank depressurization. By storing the fuel vapors in the canister, fuel emissions are reduced. At a later time, when the engine is in operation, the stored vapors can be purged into the engine intake manifold for use as fuel. The purge fuel vapors may be ramped in at a defined purge rate so that a target fuel vapor flow level is gradually reached. The ramped purge improves engine stability by reducing the likelihood of an engine stall which can occur if the canister that was being purged was loaded.

Various approaches have been developed to expedite release of fuel vapors from a fuel system canister. One example approach is shown by Cullen et al. in U.S. Pat. No. 6,820,597. Therein, based on the purge load, purge fuel vapors are directed to one or more groups of cylinders of an engine. Specifically, when the purge load is lower, the purge fuel vapors are directed to one group of cylinders that are operating with a leaner air-fuel ratio while a remaining group of cylinders continues to operate at stoichiometry.

However the inventor herein has recognized potential issues with such an approach. As one example, even with the selective purging, an engine stall may occur. Specifically, when purging is initiated for a first time since engine crank on a drive cycle, the canister loading state may not be definitely known, leading to significant air-fuel ratio excursions. For example, if the fuel tank was refueled and the vehicle was parked in an area with high solar loading for an extended amount of time, the canister could be highly loaded. As a result, when a canister purge valve is opened, a rich air-fuel ratio excursion can occur. It may take a few seconds of transport delay before an exhaust oxygen sensor responds to the rich excursion, and for the engine controller to learn how rich the canister is, and compensate injector fueling in accordance with the learned excursion. Consequently, in that duration when the purging is occurring "open loop", without exhaust oxygen sensor feedback, there may be an elevated risk for an engine stall. The issue may be exacerbated when the purge rate is ramped. In addition, vehicle motion can cause fuel slosh, during which vapor slugs from the fuel tank can enter the engine intake. If vapor slug generation is inferred, the controller may shut off purge control to avert the rich fuel excursion which could stall the engine. However, shutting off purge control may be intrusive and can result in increased emissions. Thus, it may become difficult to balance and coordinate engine stalls, purge control, and exhaust emissions control.

Another issue is that the slower purge ramp rate used to provide higher engine stability may result in incomplete canister cleaning, especially in hybrid and start/stop vehicles having limited engine operation times. If a canister is not completely purged during engine operation, exhaust emissions may be affected.

The inventor herein has recognized the issue of engine stalling due to initial canister state being rich can be addressed by leveraging selective deactivation of engine cylinders. In particular, engines may be configured with variable displacement (also known as variable displacement engines, or VDE) wherein certain cylinders can be selectively deactivated at low loads to reduce fuel consumption. Fueling of the selected cylinders may be deactivated, and intake and exhaust valves of the deactivated cylinders may be held closed, while the piston continues to move up and down from crankshaft momentum. As a result, the deactivated cylinders act as an air spring lowering pumping losses relative to if the cylinders were not sealed but were propelled by the active cylinders. Selective cylinder deactivation thereby essentially seals the selected cylinders and keeps purge vapors (that could result in an engine stall) from reaching them. Thus in one example, engine stalls during canister purging can be addressed by a method for an engine of a vehicle, comprising: deactivating one or more cylinders in response to a request to purge fuel vapors from a canister; and deactivating purge and reactivating the deactivated cylinders in response to an indication of engine stall.

As one example, prior to an initial "open loop" canister purge operation after an engine start, a controller may deactivate a threshold number of engine cylinders so as to protect them from inhaling rich canister vapors. The threshold number of cylinders that are deactivated may be based at least on vehicle occupancy, the number of cylinder deactivated increases as vehicle occupancy decreases. To further reduce the risk of a potential engine stall, the purge ramp rate may be increased relative to a default rate during the open loop purge control. If after initiating the canister purge, engine operating conditions are indicative of a potential engine stall (such as responsive to an engine speed dip), the canister purge may be temporarily suspended and the deactivated cylinders may be reactivated and fueled to prevent a complete engine stall. By resuming fueling to all engine cylinders, the rich vapors may be purged out of the "stalled" cylinders and expelled from the tailpipe. Then, canister purging can be resumed at a lower purge ramp rate in view of the learned rich excursion.

In this way, engine stalls resulting from canister purging can be averted. The technical effect of purging a canister, whose loading state is not known, to an engine with one or more cylinders selectively deactivated is that the deactivated cylinders can be protected from a rich excursion and an associated stall. In addition, purging can be performed at a higher purge ramp rate which allows for a faster canister purge. This may allow for a more complete canister cleaning in the limited engine run time available in hybrid vehicles. By reactivating the cylinders responsive to parameters indicative of a potential stall, the rich purge vapors can be purged from the active cylinders that ingested the vapors, and a complete engine stall can be averted. Further, engine stalls resulting from a vapor slug during fuel slosh can also be averted.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
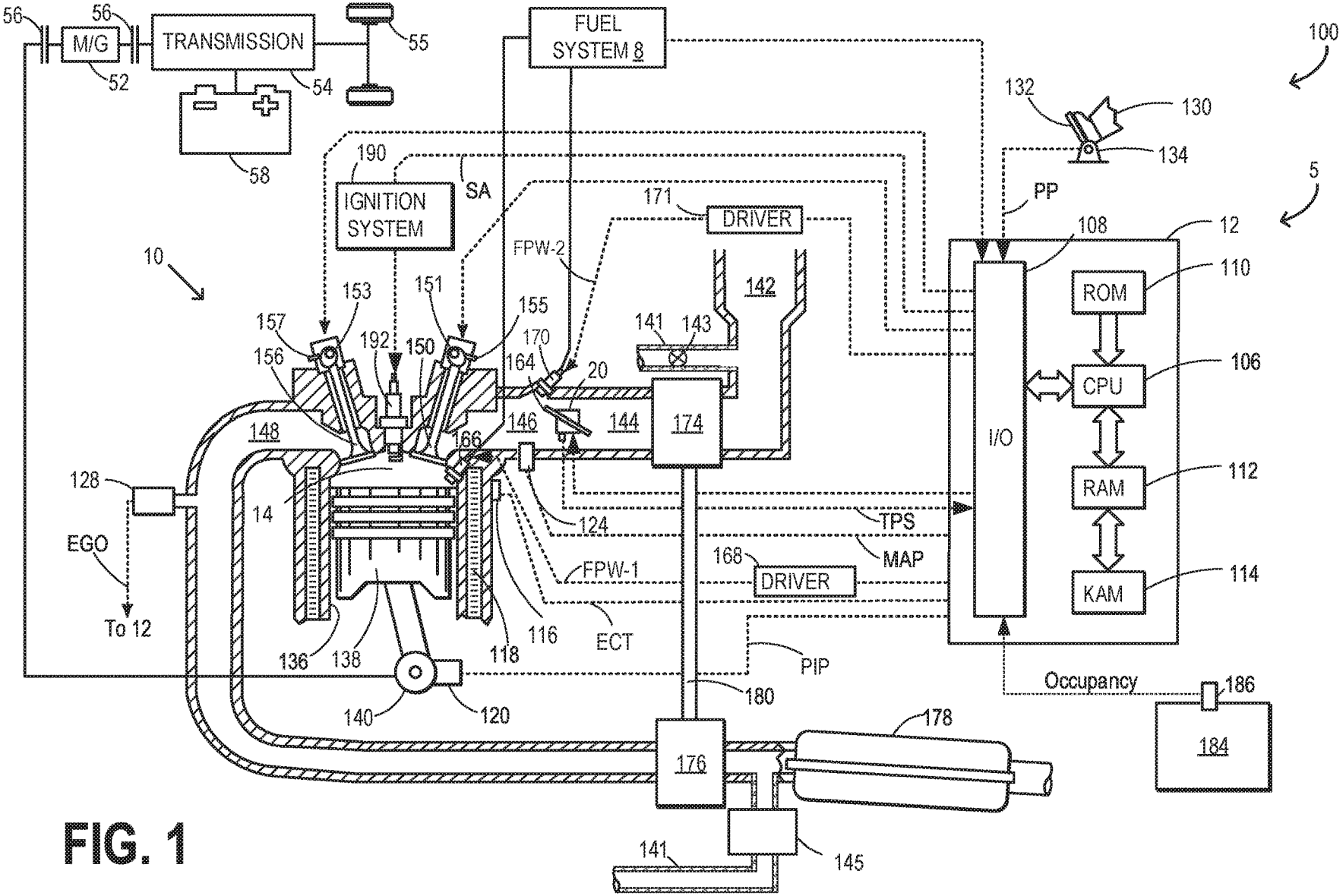
FIG. 1 shows an example engine system in a hybrid vehicle.
Figure 2:
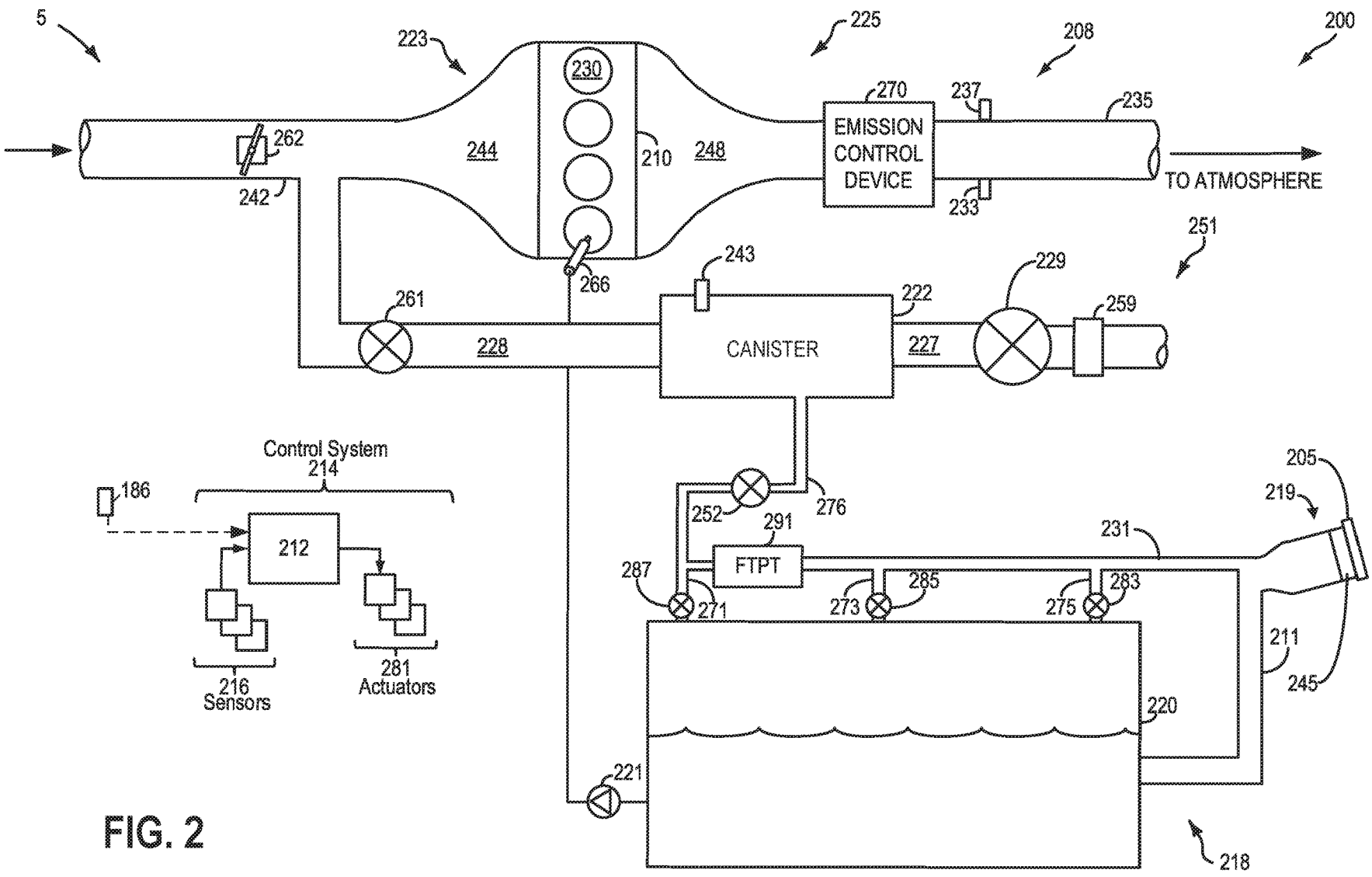
FIG. 2 shows an example fuel vapor recovery system coupled to the engine system of FIG. 1.

The following description relates to systems and methods for reducing engine stalls during purging of a fuel system canister, such as in the fuel vapor recovery system of FIG. 2, coupled in the engine system of FIG. 1. A controller may be configured to perform a control routine, such as the example routine of FIG. 3, to purge a canister, at a higher purge rate, to an engine having one or more cylinders selectively deactivated. In response to an indication of potential engine stall, the deactivated cylinders may be reactivated and the purge rate may be lowered.

Turning now to FIG. 1, an example embodiment 100 of a combustion chamber or cylinder of an internal combustion engine 10 is shown. Engine 10 may be coupled to a propulsion system, such as vehicle system 5 configured for on-road travel. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown).

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178. Exhaust gas sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one poppet-style intake valve 150 and at least one poppet-style exhaust valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT), and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

In some embodiments, each cylinder of engine 10 may include a spark plug 192 for initiating combustion. Ignition system 190 can provide an ignition spark to cylinder 14 via spark plug 192 in response to spark advance signal SA from controller 12, under select operating modes. In other embodiments, such as where cylinder combustion is initiated using compression ignition, the cylinder may not include a spark plug.

In some embodiments, each cylinder of engine 10 may be configured with one or more injectors for delivering fuel to the cylinder. As a non-limiting example, cylinder 14 is shown including two fuel injectors 166 and 170. Fuel injectors 166 and 170 may be configured to deliver fuel received from fuel system 8 via a high pressure fuel pump, and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12.

Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 2 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing.

As elaborated below, engine 10 may be a variable displacement engine wherein fuel injector 166 is selectively deactivatable responsive to operator torque demand to operate the engine at a desired induction ratio.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

Fuel may be delivered by both injectors to the cylinder during a single cycle of the cylinder. For example, each injector may deliver a portion of a total fuel injection that is combusted in cylinder 14. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof. As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

The engine may further include one or more exhaust gas recirculation passages for recirculating a portion of exhaust gas from the engine exhaust to the engine intake. As such, by recirculating some exhaust gas, an engine dilution may be affected which may improve engine performance by reducing engine knock, peak cylinder combustion temperatures and pressures, throttling losses, and NOx emissions. In the depicted embodiment, exhaust gas may be recirculated from exhaust passage 148 to intake passage 144 via EGR passage 141. The amount of EGR provided to intake passage 144 may be varied by controller 12 via EGR valve 143. Further, an EGR sensor 145 may be arranged within the EGR passage and may provide an indication of one or more of pressure, temperature, and concentration of the exhaust gas.

In some examples, vehicle system 5 may be a hybrid vehicle with multiple sources of torque available to one or more vehicle wheels 55. In other examples, vehicle system 5 is a conventional vehicle with only an engine, or an electric vehicle with only electric machine(s). In the example shown, vehicle system 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Vehicle 5 may include a cabin 184. A number of cabin occupants (that is, an occupancy level) may be sensed via an occupancy sensor 186 coupled to the cabin. Sensor 186 may include a seat sensor, a seat belt sensor, a door sensor, or any other sensor indicative Controller 12 is shown as a microcomputer, including microprocessor unit 106, input/output ports 108, an electronic storage medium for executable programs and calibration values shown as read-only memory chip 110 in this particular example, random access memory 112, keep alive memory 114, and a data bus. Controller 12 may receive various signals from sensors coupled to engine 10, in addition to those signals previously discussed, including measurement of engine coolant temperature (ECT) from temperature sensor 116 coupled to cooling sleeve 118; a profile ignition pickup signal (PIP) from Hall effect sensor 120 (or other type) coupled to crankshaft 140; throttle position (TPS) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Storage medium read-only memory chip 110 can be programmed with computer readable data representing instructions executable by microprocessor unit 106 for performing the methods described below as well as other variants that are anticipated but not specifically listed.

During selected conditions, such as when the full torque capability of the engine is not needed, one or more cylinders of engine 10 may be selected for selective deactivation. This may include selectively deactivating one or more cylinders of a group of cylinders. In one example, where the engine cylinders are divided onto two cylinder banks, one of more cylinders of a cylinder bank may be deactivated. The number and identity of cylinders deactivated on a given cylinder bank may be symmetrical or asymmetrical. By adjusting the number of cylinders that are deactivated, the induction ratio provided at the engine can be varied. The selected cylinders may be deactivated by shutting off the respective direct fuel injectors while maintaining operation of the intake and exhaust valves such that air may continue to be pumped through the cylinders. In some examples, cylinders may be deactivated to provide a specific induction ratio or firing pattern based on a designated control algorithm.

During selected conditions, such as when the full torque capability of the engine is not needed, one or more cylinders of engine 10 may be selected for selective deactivation (herein also referred to as individual cylinder deactivation). This may include selectively deactivating one or more cylinders on the cylinder bank 15. The number and identity of cylinders deactivated on the cylinder bank may be symmetrical or asymmetrical. By adjusting the number of cylinders that are deactivated, the induction ratio provided at the engine can be varied.

In addition to deactivating fuel injectors, controller 12 may close individual cylinder valve mechanisms, such as intake valve and exhaust valve mechanisms. Cylinder valves may be selectively deactivated via hydraulically actuated lifters (e.g., lifters coupled to valve pushrods), via a cam profile switching mechanism in which a cam lobe with no lift is used for deactivated valves, or via the electrically actuated cylinder valve mechanisms coupled to each cylinder. In addition, spark to the deactivated cylinders may be stopped.

While the selected cylinders are disabled, the remaining enabled or active cylinders continue to carry out combustion with fuel injectors and cylinder valve mechanisms active and operating. To meet the torque requirements, the engine produces the same amount of torque on the active cylinders. This requires higher manifold pressures, resulting in lowered pumping losses and increased engine efficiency. Also, the lower effective surface area (from only the enabled cylinders) exposed to combustion reduces engine heat losses, improving the thermal efficiency of the engine.

FIG. 2 shows a schematic depiction of vehicle system 200 including an engine system 208 coupled to an emissions control system 251 and a fuel system 218. Emissions control system 251 includes a fuel vapor container such as fuel vapor canister 222 which may be used to capture and store fuel vapors. In some examples, vehicle system 5 may be a hybrid electric vehicle system, such as vehicle system 100 of FIG. 1, and fuel system 218 may include fuel system 8 of FIG. 1.

The engine system 208 may include engine 210 having a plurality of cylinders 230. In one example, engine 210 includes engine 10 of FIG. 1. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Injector 266 may be a selectively deactivatable direct injector, such as injector 166 of FIG. 1. By deactivating injector 266, the corresponding cylinder may be deactivated.

Vapors generated in fuel system 218 may be routed to an evaporative emissions control system 251 which includes fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe 211 or neck 211.

Further, fuel filler system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refueling request, e.g., a vehicle operator initiated request via actuation of a refueling button on a vehicle dashboard, the fuel tank may be depressurized and the fuel cap unlocked after the pressure or vacuum in the fuel tank falls below a threshold. Herein, unlocking the refueling lock 245 may include unlocking the fuel cap 205. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more fuel vapor canisters 222 (herein also referred to simply as canister) filled with an appropriate adsorbent, the canisters configured to temporarily trap fuel vapors (including vaporized hydrocarbons) generated during fuel tank refilling operations and "running loss" vapors (that is, fuel vaporized during vehicle operation). In one example, the adsorbent used is activated charcoal. Emissions control system 251 may further include a canister ventilation path or vent line 227 which may route gases out of the fuel vapor canister 222 to the atmosphere when storing, or trapping, fuel vapors from fuel system 218.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions (such as certain engine running conditions) so that vacuum from engine intake manifold 244 is applied on the fuel vapor canister for purging. In some examples, vent line 227 may include an optional air filter 259 disposed therein upstream of canister 222. Flow of air and vapors between canister 222 and the atmosphere may be regulated by a canister vent valve 229.

Fuel tank 220 is fluidically coupled to canister 222 via conduit 276 which includes a fuel tank isolation valve (FTIV) 252 for controlling the flow of fuel tank vapors into canister 222. FTIV 252 may be normally closed so that fuel tank vapors (including running loss and diurnal loss vapors) can be retained in the fuel tank, such as in the ullage space of the fuel tank. In one example, FTIV 252 is a solenoid valve.

In configurations where the vehicle system 200 is a hybrid electric vehicle (HEV), fuel tank 220 may be designed as a sealed fuel tank that can withstand pressure fluctuations typically encountered during normal vehicle operation and diurnal temperature cycles (e.g., steel fuel tank).

In addition, the size of the canister 222 may be reduced to account for the reduced engine operation times in a hybrid vehicle. However, for the same reason, HEVs may also have limited opportunities for fuel vapor canister purging operations. Therefore the use of a sealed fuel tank with a closed FTIV (also referred to as NIRCOS, or Non Integrated Refueling Canister Only System), prevents diurnal and running loss vapors from loading the fuel vapor canister 222, and limits fuel vapor canister loading via refueling vapors only. FTIV 252 may be selectively opened responsive to a refueling request so depressurize the fuel tank 220 before fuel can be received into the fuel tank via fuel filler pipe 211.

In some embodiments, an additional pressure control valve (not shown) may be configured in parallel with FTIV 252 to relieve any excessive pressure generated in the fuel tank, such as while the engine is running or even vent excessive pressure from the fuel tank when the vehicle is operating in electric vehicle mode, for example in the case of a hybrid electric vehicle.

When opened, FTIV 252 allows for the venting of fuel vapors from fuel tank 220 to canister 222. Fuel vapors may be stored in canister 222 while air stripped off fuel vapors exits into atmosphere via canister vent valve 229. Stored fuel vapors in the canister 222 may be purged to engine intake 223, when engine conditions permit, via canister purge valve 261.

Fuel system 218 may be operated by a controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open FTIV 252 and canister vent valve 229 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open FTIV 252 and CVV 229, while maintaining canister purge valve 261 closed, to depressurize the fuel tank before allowing enabling fuel to be added therein. As such, FTIV 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve (CPV) 261 and canister vent valve (CVV) 229 while closing isolation valve 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 222 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

When purging is initiated for a first time since engine crank on a drive cycle, the canister loading state may not be definitely known, leading to significant air-fuel ratio excursions. For example, if the fuel tank was refueled and the vehicle was parked in an area with high solar loading for an extended amount of time before a given drive cycle is initiated, the canister could be highly loaded. Consequently, when CPV 261 is opened, a rich air-fuel ratio excursion can occur. It may take a few seconds of transport delay before an exhaust oxygen sensor responds to the rich excursion, and for the engine controller 212 to learn how rich the canister is, and compensate injector fueling in accordance with the learned excursion. Thus in that duration, the purging is occurring "open loop", without feedback from an exhaust oxygen sensor (such as sensor 128 of FIG. 1). This can increase the risk for an engine stall. To reduce the risk, the purge rate can be lowered, however, this can reduce the likelihood that the canister will be fully cleaned during the limited engine run time of a hybrid vehicle. The issue may be exacerbated when the purge rate is ramped. In addition, vehicle motion can cause fuel slosh, during which vapor slugs from the fuel tank can enter the engine intake and trigger an engine stall.

Figure 3:
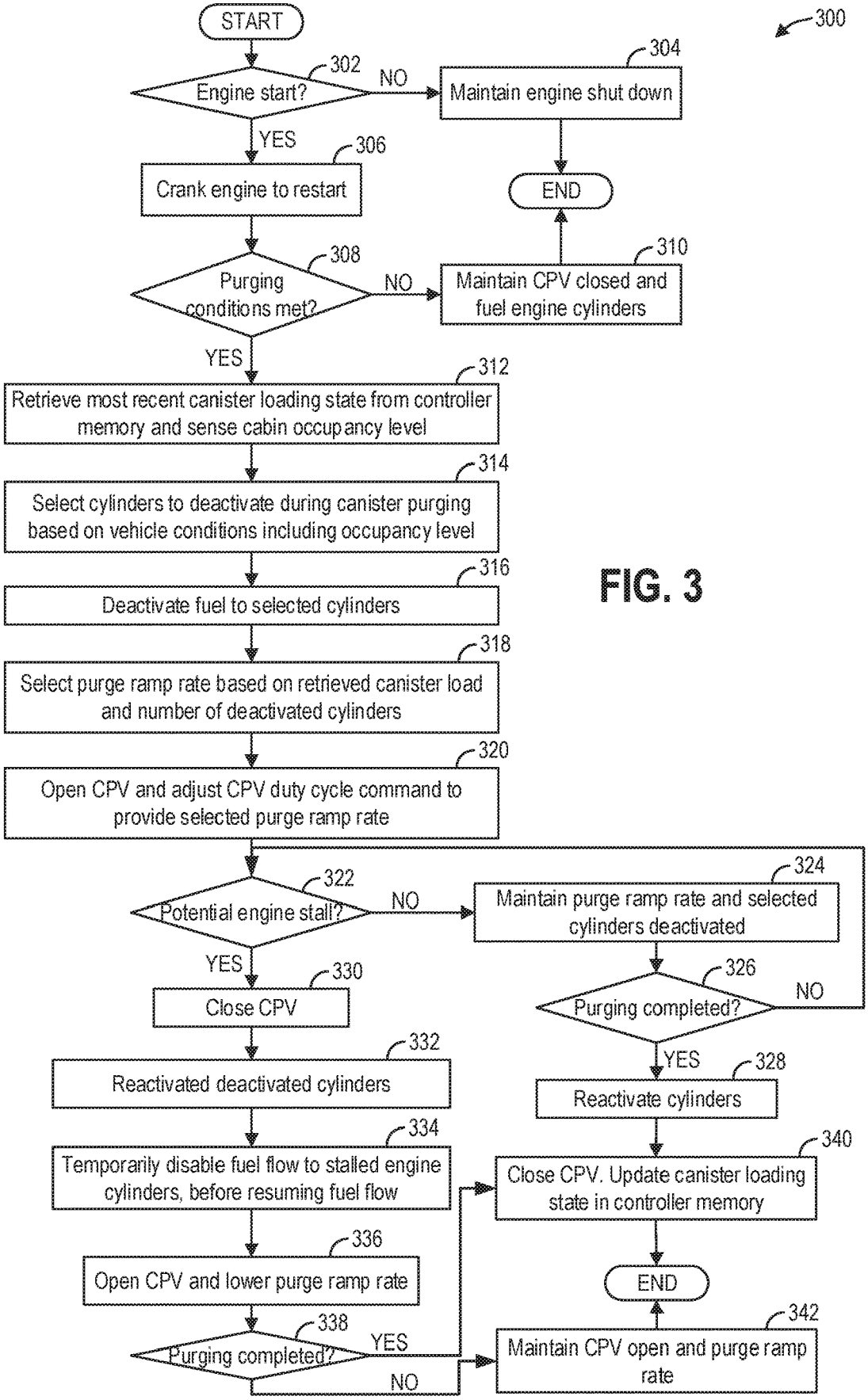
FIG. 3 shows a high level flow chart of an example method for selectively deactivating and reactivating engine cylinders during purging of a fuel system canister.

As elaborated herein with reference to FIG. 3, to reduce the incidence of engine stalls during canister purging, canister 222 can be purged with one or more cylinders 230 selectively deactivated. The number of cylinders deactivated may be based on the occupancy level of the vehicle's cabin, such as based on input from sensor 186. Since the intake and exhaust valves of the deactivated cylinders are held closed, while the piston continues to move up and down from crankshaft momentum, the deactivated cylinders are sealed from ingesting the rich purge vapors, thereby averting an engine stall. Further, if an engine stall is anticipated, the deactivated cylinders can be reactivated and purge can be temporarily disabled. As a result, the active engine cylinders can purge out the inhaled vapors.

The vehicle system 206 may further include a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, fuel tank pressure transducer (FTPT) or pressure sensor 291, and canister temperature sensor 243. As such, pressure sensor 291 provides an estimate of fuel system pressure. In one example, the fuel system pressure is a fuel tank pressure, e.g. within fuel tank 220. Other sensors such as pressure, temperature, air/fuel ratio, and composition sensors may be coupled to various locations in the vehicle system 206. As another example, the actuators may include fuel injector 266, throttle 262, FTIV 252, and pump 221. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 3. The controller 212 receives signals from the various sensors of FIGS. 1-2 and employs the various actuators of FIGS. 1-2 to adjust vehicle operation based on the received signals and instructions stored on a memory of the controller.

For example, responsive to canister load being higher than a threshold, the controller may command CPV 261 open and disable injector 266 in a number of engine cylinders, the number selected based on input from occupancy sensor 186. Specifically, as the occupancy level decreases, the number of cylinders that are deactivated are increased. Further, responsive to an indication of engine stall, as inferred from a drop in engine speed sensed via a speed sensor (e.g., sensor 120 in FIG. 1), the deactivated cylinders may be reactivated and the CPV may be commanded closed to temporarily suspend canister purging.

In this way, the components of FIGS. 1-2 enable a system comprising an engine having a plurality of cylinders, each cylinder having a selectively deactivatable fuel injector; an engine speed sensor; a fuel system including a fuel tank, a fuel vapor canister, and a purge valve coupling the canister to an engine intake; an occupancy sensor coupled to a vehicle cabin; and a controller with computer readable instructions stored on non-transitory memory that when executed cause the controller to: in response to canister load higher than a threshold, deactivating a number of cylinders and operating the purge valve with a first duty cycle to purge canister fuel vapors to remaining active cylinders; and in response to an indication of stall in one or more of the remaining active cylinders, reactivating the number of cylinders, and for a duration, closing the purge valve and disabling fuel flow to the remaining active cylinders. Additionally or optionally, the controller includes further instructions that when executed cause the controller to select the number of cylinders to deactivate as a function of an output of the occupancy sensor; deactivate the number of cylinders by disabling fuel flow through corresponding fuel injectors and holding corresponding intake and exhaust valves closed; and reactivate the number of cylinders by enabling fuel flow through the corresponding fuel injectors before opening the corresponding intake valve. Further, the controller may include instructions that when executed cause the controller to, after the duration, resume fuel flow to the remaining active cylinders and re-operate the purge valve with a second duty cycle, smaller than the first duty cycle, the second duty cycle lowered relative to the first duty cycle as a function of a number of cylinders that are deactivated. That is, the second purge rate is reduced proportionate to a cylinder deactivation amount. For example, if half the cylinders are deactivated, then the purge rate is reduced to 50%.

Turning now to FIG. 3, an example method 300 is shown for purging a canister to an engine while reducing an occurrence of engine stall by leveraging selective cylinder deactivation. Instructions for carrying out method 300 may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, the method includes confirming an engine start from a condition of engine rest. In one example, an engine may be restarted from a shutdown condition responsive to an operator inserting an active key into an ignition slot, actuating a start/stop button to a start setting, or inserting a passive key into a vehicle cabin. Further still, in engines configured to be automatically shut down and restarted responsive to engine operating conditions, the engine may be restarted responsive to a torque demand, the need to operate an air conditioning compressor, or to charge a system battery. If engine start conditions are not met, at 304, the engine is maintained shut down. The method then exits.

If engine start conditions are met, then at 306, the engine is cranked via a starter motor to restart the engine. For example, the engine is cranked until a threshold speed, such as 400 rpm, after which engine fueling can resume to sustain engine rotation.

After cranking the engine via the starter motor, and before resuming cylinder fueling, at 308, it is determined if purging conditions are present. In one example, purging conditions are confirmed if the inferred canister load at the end of a last drive cycle is higher than a non-zero threshold load (such as when the canister is more loaded in the range of 20-100%). In another example, canister purging conditions may be confirmed any time the engine is operated to generate torque to propel the vehicle. If canister purging conditions are not met, then at 310, the method includes maintaining a canister purge valve closed and initiating fuel delivery to engine cylinders. The engine may operate with a number of cylinders deactivated, the number determined as a function of torque demand. In particular, the number of cylinders that are deactivated may be increased as the operator torque demand decreases. The routine then exits.

If purging conditions are met, then at 312, the method includes retrieving the most recent canister loading state from the controller's memory. In addition, a cabin occupancy level is determined based on occupancy sensor input. At 314, the method includes selecting a number of cylinders to deactivate during the canister purging based on vehicle conditions including the occupancy level. As such, a tradeoff exists between the number of deactivated cylinders and the risk for engine stalls. In one example, as the number of occupants in the cabin decreases (such as below a non-zero threshold, the number of cylinders that are deactivated may be increased. As an example, when the occupancy level is 50%, the engine may operate with an induction ratio of 0.5. As another example, when the occupancy level is 25%, the engine may operate with an induction ratio of 0.25. If the vehicle is operating autonomously with no driver and no occupant, a maximum number of cylinders may be deactivated.

As such, cylinder deactivation and reactivation involves a NVH disturbance. Thus with occupants in the cabin, the cylinders may have to be deactivated one at a time or the VDE may have to be timed with a rough road condition so as to mask the NVH. However, in the case where the engine is about to stall, priority is given to preventing this undesirable condition and cylinder deactivation is engaged without consideration to NVH. Whether no occupants or maximum occupants, the VDE is engaged to prevent engine stall In some conditions, the actual canister loading at the onset of canister purging may be higher than expected (e.g., higher than the last retrieved value). This may occur, for example, due to the fuel tank being refueled before the current drive cycle. This may alternatively occur due to the vehicle being parked in an area of high solar loading for an extended duration, resulting in additional diurnal vapors being generated. If the canister loading is higher than expected, then at the initial time of initial canister purging, a rich air-fuel ratio excursion can occur, before an exhaust sensor is able to sense and compensate for it. The rich excursion can result in an engine stall. Due to the intake and exhaust valves of deactivated cylinders being held closed, the deactivated cylinders are protected from ingesting the purge vapors, including any rich vapors. Therefore by purging the canister to an engine while selectively deactivating a fraction of all engine cylinders, engine stall induced by canister purge rich excursions is averted.

At 318, a purge ramp rate is selected based on the last retrieved canister loading state and the number of deactivated cylinders. The purge ramp rate may include an initial purge rate, as well as defined stepwise increments in the purge rate over a duration of canister purging. For example, a default purge rate may be initially determined based on the canister load, and then the purge ramp rate may be increased with a gain determined as a function of the number of deactivated cylinders. Thus as the number of cylinders that are deactivated at the time of canister purging increases, the purge ramp rate may be increased relative to the default purge ramp rate. The controller may use an algorithm, model, or look-up table that uses canister load and induction ratio as inputs to determine the purge ramp rate as an output. For example, the purge step size and ramp increase rates may be dictated by engine speed and canister loading state. At higher engine speeds, the engine can handle vapor intake better than at low engine speeds. With higher engine speeds, the ramp rate can be increased. With a loaded canister, the ramp rate is decreased as to reduce over-inhalation of fuel vapor. The increase rate is dependent on the propagation delay of the UEGO response (which is typically a couple of seconds). Increasing the purge rate (relative to a default value) allows more air flow into the canister which cleans the canister faster on a given drive cycle. By purging the canister to an engine while selectively deactivating a fraction of all engine cylinders, the deactivated cylinders are protected from rich purge excursions, allowing for an overall higher than otherwise possible rate of canister purging. This allows the canister to be purged more completely without causing combustion instability at the engine even if the engine run time is limited, such as may occur in hybrid vehicle and vehicles with start/stop configurations.

At 320, canister purging is enabled to the engine with the selected number of cylinders deactivated in accordance with the determined purge rate. Specifically, the controller may command the CPV open (while also commanding a CVV open) and adjust a duty cycle of the CPV to provide the determined purge ramp rate. At the same time, the selected number of cylinders are deactivated while remaining active cylinders are fueled.

At 322, it is determined if there is a potential engine stall. Alternatively, it may be determined if there is a partial engine stall and if there is potential for a complete engine stall. In one example, a potential (or partial) engine stall may be inferred responsive to an initial rise in engine speed during cranking following by a dip in engine speed (or downward engine speed trajectory) following the delivery of fuel and purge vapors to active engine cylinders. For example, the engine speed may initially increase at a higher than threshold rate for a first duration from a state of engine rest, and then after purging is initiated, the engine speed may decrease at a higher than threshold rate for a second duration, immediately following the first duration. The partial engine stall may occur due to an engine stall in at least one of the cylinders in the fraction of cylinders that are active.

Herein, the engine stall may be a partial engine stall wherein the engine speed starts to drop (slowly) after the cranking is stopped. As elaborated below, a remedial action is taken as soon as the dip in engine speed starts to occur so that the engine does not spin to rest and come to a complete engine stall. Rather, the engine is able to recover from a potential complete engine stall.

In one example, a cylinder balance test may be used to determine which cylinders are about to stall. The Cylinder balance test may use a crankshaft position sensor (CKP sensor) and measure a rate of change in crankshaft position to infer torque output from each cylinder.

Engine stalls can occur due to vapor slugs. In particular, during hot weather conditions (e.g., higher than threshold ambient temperature), fuel present in the fuel tank may become hot. When the vehicle is in motion, there may be fuel slosh. The combination of fuel slosh due to vehicle motion and hot fuel due to elevated ambient temperature can result in vapor slugs generated in the fuel tank entering the engine intake and stalling engine cylinders that were receiving purge vapors. In particular, the richer than expected excursion caused by the sudden ingestion of a large amount of concentrated fuel vapors can stall the engine. The controller may monitor pedal displacement and drive patterns to infer if a vapor slug and an associated engine stall might occur. For example, the controller may infer vapor slug generation and predict an engine stall if there is rapid vehicle acceleration or deceleration (e.g., higher than threshold rate of pedal displacement). As another example, the controller may infer vapor slug generation and predict an engine stall if there is a sudden change (e.g., higher than threshold increase or decrease) in fuel tank pressure.

If no engine stall is indicated, or anticipated, then at 324, the method includes maintaining the higher than threshold purge ramp rate and continuing to purge the canister to the engine with the one or more cylinder selectively deactivated. While purging, the controller may continuously update the canister load based on feedback from an exhaust sensor. Alternatively, the controller may continuously update the canister load based purge conditions such as purge rate.

At 326, it may be determined if the purging is completed, such as may occur when the inferred or sensed canister load is less than a threshold load. In one example, purging conditions are considered met when the canister load is higher than an upper threshold, and purging is considered to be completed when the canister load is lower than a lower threshold. The change in canister load may be sensed by a sensor coupled to the canister (or other location in the fuel system) such as a pressure sensor, or hydrocarbon sensor. Alternatively, the change in canister load may be inferred based on a duration of canister purging, a duty cycle of the CPV, and the inferred or sensed canister load at the onset of the canister purging.

If the purging is completed, then at 328, the method includes reactivating the cylinders that were deactivated during the canister purging. This includes resuming fuel delivery to the cylinders. Thereafter engine cylinders may be selectively deactivated in accordance with torque demand. Therein, as the torque demand drops, the number of cylinders that are selectively deactivated are increased, and the torque demand is met via a fewer number of active cylinders. At 340, after reactivating the cylinders, the controller may (fully) close the CPV to disable further purging and update the canister loading state at the end of the purging operation in the controller's memory. The method then exits.

Returning to 322, if an engine stall is anticipated, then at 330, the method includes (fully) closing the CPV to disable further canister purging. By limiting the further ingestion of rich canister purge vapors, a complete engine stall is averted. At 332, the method includes reactivating the selectively deactivated cylinders and starting a timer. In one example, the deactivated cylinders are reactivated en masse. In another example, the deactivated cylinders are reactivated sequentially. In another example, the controller may reactivate the cylinder that is furthest from the CPV valve. This allows vapors to diffuse inside the intake and not concentrate at one cylinder and cause a rich misfire. Stalled cylinders are the ones that were deactivated with the VDE hardware. Reactivating the deactivated cylinders may include injecting fuel into the deactivated cylinders before intake valve opening (IVO) and combusting a previously inducted air charge. This reduces the unintended ingestion of rich purge fuel vapors into the deactivated cylinders.

In addition to reactivating the deactivated cylinders, at 334, the controller may temporarily disable fuel injector flow to the stalled cylinders which are rich with hydrocarbons from the canister purge vapors. Herein the stalled cylinders may be a fraction of the previously active cylinders, and may include less than all the engine cylinders. The stalled cylinders may be identified based on their piston position. In one example, fuel flow to the stalled cylinders may be turned off for a short duration, such as a few seconds. This allows the rich vapors ingested in the stalled engine cylinders to be purged out and expelled to the tailpipe. Then, once the rich vapors have been purged from the stalled cylinders, the controller may resume fueling all engine cylinders. As such, while fuel flow to the stalled cylinders is temporarily disabled, fueling of the reactivated cylinders (which were previously deactivated) is continued, allowing the reactivated cylinders to provide the engine torque required to meet the torque demand.

At 336, after the rich vapors have been purged from the stalled engine cylinders, the controller may resume canister purging by opening the CPV. Further, the purge ramp rate may be lowered. This includes decreasing an initial purge rate, as well as stepwise increments in the purge rate relative to the purge rate initially applied during canister purging to an engine with at least some deactivated cylinders (at 318). In one example, the lowered purge ramp rate applied after reactivating the cylinders is a function of the increased purge ramp rate applied after deactivating the cylinders. As an example, the purge ramp rate is reduced proportionate to cylinder deactivation amount.

In this way, purging can be continued even if an engine stall is anticipated due to rich fuel vapors from a loaded canister or due to hot fuel vapor slug. By mitigating the engine stall by leveraging selective cylinder deactivation and reactivation, the need to disable purge responsive to a vapor slug is averted.

From 336, the method moves to 338 to determine if purging is completed. As at 326, it may be determined that the purging is completed when the inferred or sensed canister load is less than the threshold load (e.g., below the lower threshold). The change in canister load may be sensed by a sensor coupled to the canister (or other location in the fuel system) such as a pressure sensor, or hydrocarbon sensor. Alternatively, the change in canister load may be inferred based on a duration of canister purging, a duty cycle of the CPV, and the inferred or sensed canister load at the onset of the canister purging.

If the purging is completed, then at 340, the controller may (fully) close the CPV to disable further purging and update the canister loading state at the end of the purging operation in the controller's memory. The method then exits. If the purging is not completed, then at 342, the CPV is maintained open and the lowered purge ramp rate is maintained. The method then exits.

Figure 4:
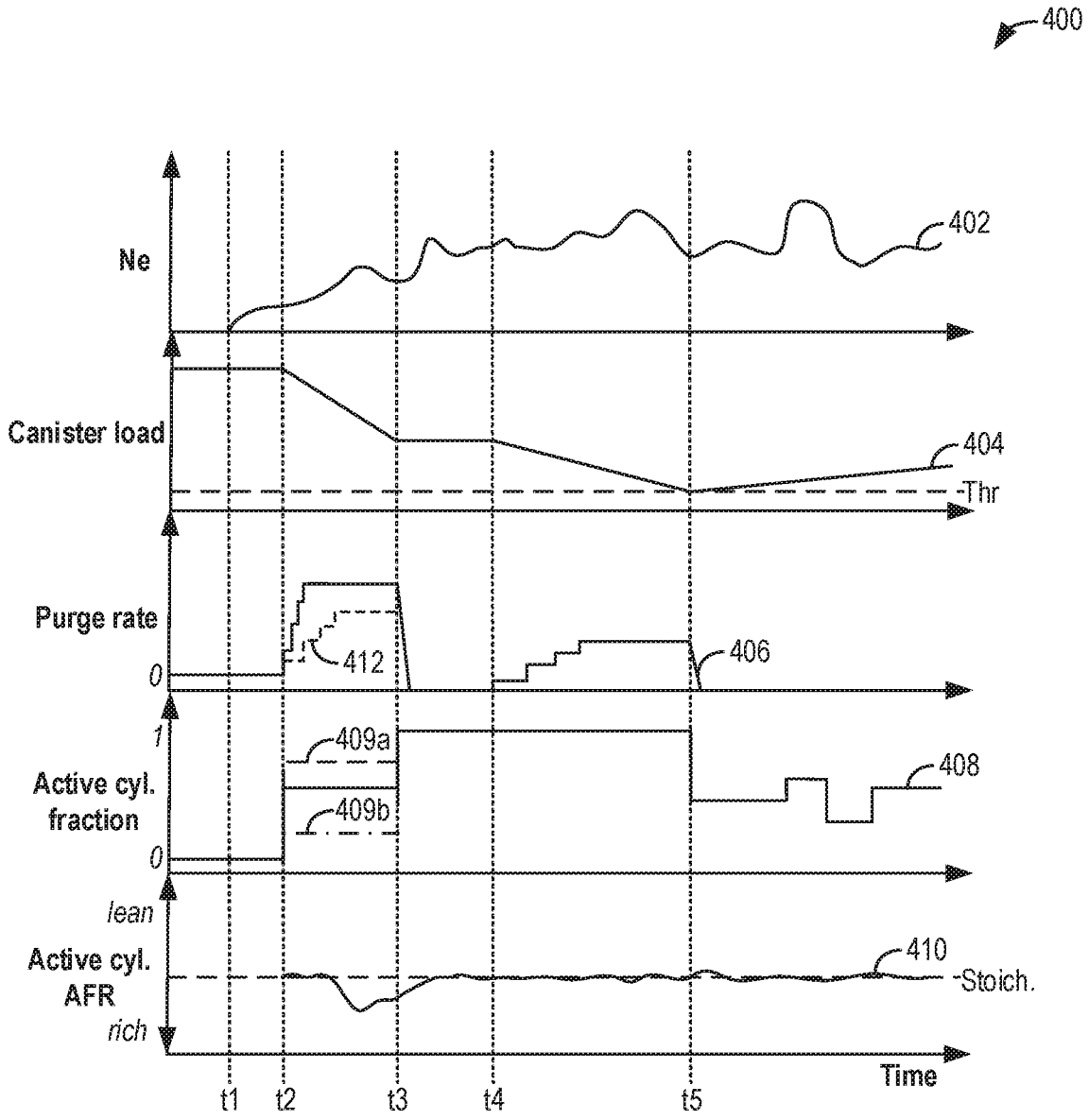
FIG. 4 shows a prophetic example of addressing engine stalls during purging of a fuel system canister by selectively deactivating and reactivating engine cylinders.

Turning now to FIG. 4, a prophetic example of a canister purging operation in a vehicle having an engine with VDE technology is shown. The vehicle may be a hybrid vehicle, such as the example vehicle system of FIG. 1. Map 400 depicts engine speed at plot 402. A fuel vapor canister loading state is shown at plot 404 relative to a threshold (Thr, dashed line). A canister purge rate is shown at plot 406. A fraction of total engine cylinders that are active is shown at plot 408. A fraction of 1.0 indicates that all cylinders are active. As the number of cylinders that are deactivated increases, the fraction decreases. An air-fuel ratio (AFR) of the active cylinders is shown at plot 410 relative to a stoichiometric AFR (dashed line). When there is more air than fuel relative to the stoichiometric AFR, a degree of leanness (and the absolute value) of the AFR increases. When there is more fuel than air relative to the stoichiometric AFR, a degree of richness of the AFR increases and the absolute value of the AFR drops. All plots are shown over time, along the x-axis.

Prior to t1, the vehicle is not moving. For example, the vehicle may be parked with the engine shutdown. The canister load stored in the controller's memory may reflect the last canister load learned by a vehicle controller prior to key-off. At key-off, the canister load is determined to be higher than a purging threshold requiring the canister to be purged on the next drive cycle.

At t1, the engine is restarted, such as responsive to an operator request an engine restart by keying on the vehicle. Between t1 and t2, the engine is cranked via a starter motor. At this time, no fuel is delivered to the engine. At t2, responsive to the engine speed exceeding a threshold cranking speed (e.g., 400 rpm), engine fueling can be resumed and the canister can be purged. To enable the canister to be purged with reduced incidence of engine stall, one or more cylinders of the engine are selectively deactivated. The number of cylinders is selected based on the vehicle occupancy level. In the depicted example, half of all engine cylinders are deactivated while remaining cylinders are maintained active (a fraction of 0.5, at plot 408). However, in other examples, the fraction may vary. For example, if the vehicle occupancy level were higher (than the level corresponding to plot 408), more cylinders would be deactivated to provide a smaller active cylinder fraction (shown at 409*b*). As another example, if the vehicle occupancy level were lower (than the level corresponding to plot 408), fewer cylinders would be deactivated to provide a larger active cylinder fraction (shown at 409*a*).

In addition, a canister purge rate and purge ramp rate that is enabled during the purging is increased relative to a default purge rate and purge ramp rate (shown at dashed segment 412). The default purging rate may correspond to a purge rate and purge ramp rate that is used if all engine cylinders were active. The increased purge rate is increased relative to the default purge rate as the number of deactivated cylinders increases. Increasing the purge rate includes operating the CPV with a larger duty cycle (indicated by a higher final step value). Increasing the purge ramp rate includes increasing a size of each step of the ramping, as well as a rate of the ramping (as indicated by a steeper slope of the ramping). As the canisters are purged, the canister load starts to drop.

While purging the canister, fueling of active cylinders is adjusted as a function of the amount of ingested fuel vapors (determined based on canister purge rate and canister load) so as to maintain the AFR of active cylinders at or around stoichiometry.

Shortly before t3, while the canister is being purged to the engine with half the total cylinders deactivated, an engine stall is predicted. Specifically, one or more of the active cylinders (but not all) may stall shortly before t3 resulting in a sudden dip in engine speed. The engine stall may be due to the ingestion of rich fuel vapors from the canister leading to a transient rich AFR excursion. In one example, this may occur on account of the canister being more loaded than was originally anticipated, such as due to the vehicle being parked for an extended duration in an area of high solar loading prior to t1.

Responsive to the indication of a potential engine stall, at t3, the deactivated cylinders are reactivated. This causes the fraction of active cylinders to move to 1. By reactivating the deactivated cylinders, the engine can be restarted on the fly via the cylinders that did not inhale the rich fuel vapors. As a result, a full engine stall (to zero speed) is averted and the engine speed can start to recover. In particular, a full engine stall can be averted even if there is a slight hesitation in engine performance, depending on how many cylinders were deactivated.

Canister purging is also concurrently disabled at t3 by closing the CPV. Also at t3, fuel is transiently disabled to the stalled engine cylinders that had ingested rich vapors so as to allow the rich fuel vapors to be rapidly purged from the cylinders to an exhaust tailpipe. Shortly after t3, when the rich fuel vapors are purged, stoichiometric fueling of the stalled engine cylinders is resumed.

Between t3 and t4, while the rich vapors are being purged from the stalled cylinders, the CPV is held closed causing a drop in the purge rate to 0. Also, the canister load holds between t3 and t4 since no purging is occurring. At t4, once the rich vapors are purged from the stalled cylinders, canister purging is resumed. However, the canisters are purged at a lower purge rate and purge ramp rate than when canister purging was initiated at t2. The lower purge ramp rate includes a smaller size of each step of the ramping, as well as a slower rate of the ramping (as indicated by a shallower slope of the ramping), as compared to the purge ramp rate applied at t2-t3. As the canisters are purged, the canister load starts to drop. At t5, the canister is cleaned of fuel vapors and canister purging is disabled.

After t5, loading of the canister with fuel vapors during engine operation resumes. Also, after t5, the fraction of engine cylinders that are selectively deactivated is varied as a function of torque demand, and independent of canister load.

In this way, engine stalls that can occur during canister purging can be minimized. The technical effect of deactivating one or more cylinders of an engine in response to a request to purge fuel vapors from a canister is that the deactivated cylinders can be sealed from ingesting potentially rich canister vapors, particularly during an open loop control phase of the purging when the canister loading state is not reliably known. In addition, engine stalls occurring due to vapors slugs from fuel slosh can be preempted. By increasing a purging ramp rate when purging the canister to an engine with one or more deactivated cylinders, the canister can be cleaned out faster on a drive cycle. The technical effect of reactivating the deactivated cylinders in response to an indication of potential engine stall is that the engine can quickly recover from a full engine stall by fueling the cylinders that did not ingest the rich vapors. By decreasing the purging ramp rate when purging the canister to the engine with all cylinders active, engine stability during the remainder of the purging operation is improved. By increasing canister purging efficiency, exhaust emissions are improved.

One example method for an engine of a vehicle, comprises: deactivating one or more cylinders in response to a request to purge fuel vapors from a canister; and deactivating purge and reactivating the deactivated cylinders in response to an indication of engine stall. In the preceding example, additionally or optionally, the method further comprises selecting a number of the one or more cylinders for deactivation as a function of vehicle occupancy level, the number increased as the occupancy level decreases. In any or all of the preceding examples, additionally or optionally, the method further comprises, before deactivating the purge, purging the fuel vapors from the canister to the engine with one or more cylinders deactivated and remaining cylinders active at a first purge ramp rate, the first purge ramp rate based on canister load the selected number of the one or more deactivated cylinders. In any or all of the preceding examples, additionally or optionally, reactivating the deactivated cylinders includes injecting fuel into the deactivated cylinders before intake valve opening (IVO) and combusting a previously inducted air charge in the deactivated cylinders. In any or all of the preceding examples, additionally or optionally, the method further comprises, responsive to the indication of engine stall, temporarily disabling fuel flow to the remaining active cylinders, pumping at least some purge fuel vapors from an intake manifold of the engine to an exhaust tailpipe via the reactivated cylinders, and resuming fuel flow in the remaining active cylinders after the pumping. In any or all of the preceding examples, additionally or optionally, the method further comprises reactivating the purge after a duration, the duration based on the number of the one or more deactivated cylinders, the duration increased as the number decreases. In any or all of the preceding examples, additionally or optionally, the method further comprises, after reactivating the purge, purging the fuel vapors from the canister to the engine with all cylinders reactivated at a second purge ramp rate, lower than the first purge ramp rate. In any or all of the preceding examples, additionally or optionally, the second purge ramp rate is lowered relative to the first purge ramp rate as an amount of cylinder deactivation increases. In any or all of the preceding examples, additionally or optionally, the indication of engine stall includes an indication of partial engine stall or an anticipation of full engine stall.

Another example method for a vehicle engine comprises operating in a first purge mode including purging fuel vapors from a canister to an engine with a number of cylinders deactivated and remaining cylinders active at a first purge ramp rate; and operating in a second purge mode including purging fuel vapors from the canister to the engine with all cylinders active at a second purge ramp rate, lower than the first purge ramp rate. In any or all of the preceding examples, additionally or optionally, the method further comprises transitioning from the first purge mode to the second purge mode responsive to an indication of potential engine stall. In any or all of the preceding examples, additionally or optionally, the transitioning includes reactivating the number of deactivated cylinders and temporarily disabling fuel flow to the remaining active cylinders. In any or all of the preceding examples, additionally or optionally, fuel flow to the remaining active cylinders is re-enabled after purging fuel vapors from an engine intake manifold to an exhaust tailpipe via the number of deactivated cylinders for a duration. In any or all of the preceding examples, additionally or optionally, operating in the first purge mode is responsive to canister load being higher than a threshold load upon completion of engine cranking following an engine start from rest. In any or all of the preceding examples, additionally or optionally, operating in the first purge mode further includes selecting the number of deactivated cylinders as a function of a vehicle occupancy level, the number increased as the vehicle occupancy level decreases. In any or all of the preceding examples, additionally or optionally, operating the engine with the selected number of deactivated cylinders includes disabling a fuel injector and closing each of an intake valve and an exhaust valve of each of the selected number of deactivated cylinders. In any or all of the preceding examples, additionally or optionally, the first purge ramp rate includes a first purge step size and a first rate of change between consecutive steps, and wherein the second purge ramp rate includes a second purge step size, smaller than the first purge step size, and a second rate of change between consecutive steps smaller than the first rate of change between consecutive steps.

Another example vehicle system comprises: an engine having a plurality of cylinders, each cylinder having a selectively deactivatable fuel injector; an engine speed sensor; a fuel system including a fuel tank, a fuel vapor canister, and a purge valve coupling the canister to an engine intake; an occupancy sensor coupled to a vehicle cabin; and a controller with computer readable instructions stored on non-transitory memory that when executed cause the controller to: in response to canister load higher than a threshold, deactivating a number of cylinders and operating the purge valve with a first duty cycle to purge canister fuel vapors to remaining active cylinders; and in response to an indication of stall in one or more of the remaining active cylinders, reactivating the number of cylinders, and for a duration, closing the purge valve and disabling fuel flow to the remaining active cylinders. In any or all of the preceding examples, additionally or optionally, the controller includes further instructions that when executed cause the controller to select the number of cylinders to deactivate as a function of an output of the occupancy sensor; deactivate the number of cylinders by disabling fuel flow through corresponding fuel injectors and holding corresponding intake and exhaust valves closed; and reactivate the number of cylinders by enabling fuel flow through the corresponding fuel injectors before opening the corresponding intake valve. In any or all of the preceding examples, additionally or optionally, the controller includes further instructions that when executed cause the controller to, after the duration, resume fuel flow to the remaining active cylinders and re-operate the purge valve with a second duty cycle, smaller than the first duty cycle, the second duty cycle lowered relative to the first duty cycle as a function of cylinder deactivation amount.

In a further representation, the vehicle system is a hybrid vehicle system or an autonomous vehicle system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine of a vehicle, comprising:

deactivating one or more cylinders in response to a request to purge fuel vapors from a fuel vapor canister of an evaporative emissions control system, the fuel vapor canister filled with an adsorbent; and deactivating purge and reactivating the one or more deactivated cylinders in response to an indication of engine stall.

2. The method of claim 1, further comprising, selecting a number of the one or more cylinders for deactivation as a function of a vehicle occupancy level, the number increased as the vehicle occupancy level decreases.

3. The method of claim 2, further comprising, before deactivating the purge, purging the fuel vapors from the fuel vapor canister to the engine with the one or more deactivated cylinders and remaining active cylinders at a first purge ramp rate, the first purge ramp rate based on a canister load of the fuel vapor canister and the number of the one or more deactivated cylinders.

4. The method of claim 1, wherein reactivating the one or more deactivated cylinders includes injecting fuel into the deactivated cylinders before intake valve opening (IVO) and combusting a previously inducted air charge in the deactivated cylinders.

5. The method of claim 3, further comprising, responsive to the indication of engine stall, temporarily disabling fuel flow to the remaining active cylinders, pumping at least some purge fuel vapors from an intake manifold of the engine to an exhaust tailpipe via the reactivated cylinders, and resuming fuel flow in the remaining active cylinders after the pumping.

6. The method of claim 3, further comprising, reactivating the purge after a duration, the duration based on the number of the one or more deactivated cylinders, the duration increased as the number decreases.

7. The method of claim 6, further comprising:

after reactivating the purge, purging the fuel vapors from the fuel vapor canister to the engine with all cylinders reactivated at a second purge ramp rate, lower than the first purge ramp rate.

8. The method of claim 7, wherein the second purge ramp rate is lowered relative to the first purge ramp rate as a cylinder deactivation amount increases.

9. The method of claim 1, wherein the indication of engine stall includes an indication of partial engine stall or an anticipation of full engine stall.

10. A method for a vehicle engine, comprising:

operating in a first purge mode, the first purge mode including purging fuel vapors from an adsorbent-filled fuel vapor canister of an evaporative emissions control system to an engine with a number of cylinders deactivated and remaining cylinders active at a first purge ramp rate; and operating in a second purge mode, the second purge mode including purging the fuel vapors from the adsorbent-filled fuel vapor canister to the engine with all cylinders active at a second purge ramp rate, lower than the first purge ramp rate.

11. The method of claim 10, further comprising, transitioning from the first purge mode to the second purge mode responsive to an indication of potential engine stall.

12. The method of claim 11, wherein the transitioning includes reactivating the number of deactivated cylinders and temporarily disabling fuel flow to the remaining active cylinders.

13. The method of claim 12, wherein fuel flow to the remaining active cylinders is re-enabled after purging the fuel vapors from an engine intake manifold to an exhaust tailpipe via the number of deactivated cylinders for a duration.

14. The method of claim 10, wherein operating in the first purge mode is responsive to a canister load of the adsorbent-filled fuel vapor canister being higher than a threshold canister load upon completion of engine cranking following an engine start from rest.

15. The method of claim 10, wherein operating in the first purge mode further includes selecting the number of deactivated cylinders as a function of a vehicle occupancy level, the number increased as the vehicle occupancy level decreases.

16. The method of claim 15, wherein operating the engine with the number of deactivated cylinders includes disabling a fuel injector and closing each of an intake valve and an exhaust valve of each of the number of deactivated cylinders.

17. The method of claim 10, wherein the first purge ramp rate includes a first purge step size and a first rate of change between consecutive steps, and wherein the second purge ramp rate includes a second purge step size, smaller than the first purge step size, and a second rate of change between consecutive steps, smaller than the first rate of change between consecutive steps.

18. A vehicle system, comprising:

an engine having a plurality of cylinders, each cylinder having a selectively deactivatable fuel injector;

an engine speed sensor;

a fuel system including a fuel tank, a fuel vapor canister filled with an adsorbent, and a purge valve coupling the fuel vapor canister to an intake of the engine;

an occupancy sensor coupled to a vehicle cabin; and a controller with computer readable instructions stored on non-transitory memory that when executed cause the controller to:

in response to a canister load of the fuel vapor canister being higher than a threshold, deactivate a number of cylinders and operate the purge valve with a first duty cycle to purge canister fuel vapors from the fuel vapor canister to remaining active cylinders; and in response to an indication of stall in one or more of the remaining active cylinders, reactivate the number of cylinders, and for a duration, close the purge valve and disable fuel flow to the remaining active cylinders.

19. The system of claim 18, wherein the controller includes further instructions that when executed cause the controller to:

select the number of cylinders to deactivate as a function of an output of the occupancy sensor;

deactivate the number of cylinders by disabling fuel flow through corresponding fuel injectors and holding corresponding intake and exhaust valves closed; and reactivate the number of cylinders by enabling fuel flow through the corresponding fuel injectors before opening the corresponding intake valve.

20. The system of claim 19, wherein the controller includes further instructions that when executed cause the controller to:

after the duration, resume fuel flow to the remaining active cylinders and re-operate the purge valve with a second duty cycle, smaller than the first duty cycle, the second duty cycle lowered relative to the first duty cycle as a function of a cylinder deactivation amount.

* * * * *